United States Patent [19]

Herman

[11] 3,994,198

[45] Nov. 30, 1976

[54] CYMBAL RETAINER

[76] Inventor: Craig C. Herman, Rte. 10, Box 74, San Antonio, Tex. 78216

[22] Filed: Aug. 27, 1975

[21] Appl. No.: 608,074

[52] U.S. Cl. ..... 84/421; 84/422 R

[51] Int. Cl.[2] ..... G10D 13/02

[58] Field of Search ..... 84/422, 421, 403, 402

[56] References Cited

UNITED STATES PATENTS

| | | | |
|---|---|---|---|
| 2,163,949 | 6/1939 | Kiemle | 84/422 |
| 3,336,827 | 8/1967 | Gaylor | 84/422 |
| 3,705,528 | 12/1972 | Cordes | 84/422 |

*Primary Examiner*—Stephen J. Tomsky
*Attorney, Agent, or Firm*—Willard J. Hodges, Jr.

[57] ABSTRACT

A unitary retainer for a cymbal on a stand. The combination employs a conventional stand for supporting a cymbal at the suitable height for playing by a drummer in a band. The essence of the invention is a one-piece retainer secured to the cymbal rod. The unit employs a threaded cymbal base with an integral drive nut; a sloping, flared shoulder; and the cymbal neck extending into flexible arms and a flared retaining head for passing through the hole in a cymbal and flaring to a fully extended dimension for retaining the cymbal on the stand.

6 Claims, 5 Drawing Figures

CYMBAL RETAINER

BACKGROUND OF THE INVENTION

1. Field of the Invention

This invention is an improvement on the cymbal holders used by drummers throughout the world. The cymbal retainer of this invention is a unitary, one-piece structure designed to replace and supplant the present multiple component structures used for retaining the cymbal on a stand.

2. Description of Prior Art

The present cymbal holders generally utilized throughout the music industry employ a cymbal stand which terminates in a 3/16 inch rod at its upper extremity. There is a small flare or breaker on the rod over which is fitted a washer-like metal cup. A felt washer rests on the cup. The cymbal rod is covered by a rubber or nylon sleeve over which the cymbal fits with the sleeve passing through the ½ inch diameter center hole in the cymbal and the components are retained on the rod by a wing nut.

Some modified devices have been developed and patented; such as, Cordes, U.S. Pat. No. 3,705,528; and Gaylor, U.S. Pat. No. 3,336,827.

SUMMARY OF THE INVENTION

The cymbal retainer of this invention is a one-piece, nylon plastic device for screwing on a cymbal rod for receiving and supporting a cymbal in the playing position. The structure of the device summarily comprises a conventional cymbal stand to which is threadably secured an integral, one-piece cymbal retainer. The device generally consists of a cymbal base extending laterally to form a flared shoulder. The felt washer fits around and over the cymbal neck projecting upward from the cymbal base extending into two parallel, flexible arms which terminate in a flared retaining head. The cymbal center hole is placed over the flexible arms and rests on a felt collar supported by the flared shoulder of the cymbal base. The flexible arms flex outward carrying the flexible retaining head to secure the cymbal to the stand.

One of the principal objects of the invention was to replace multiple parts by a single, integral structure.

An object was to improve the musical qualities of the cymbal while protecting the structure of the cymbal.

Another object was esthetic appeal to the playing drummer.

Other objects and advantages will, undoubtedly, be apparent to those skilled in the art from a review of the specification, claims and a study of the attached drawings.

For a detailed description of the construction of the preferred embodiment and its use reference is made to the attached views wherein identical reference characters refer to identical or equivalent components throughout the several views and the following description.

DESCRIPTION OF THE PREFERRED EMBODIMENT

Figure 2:
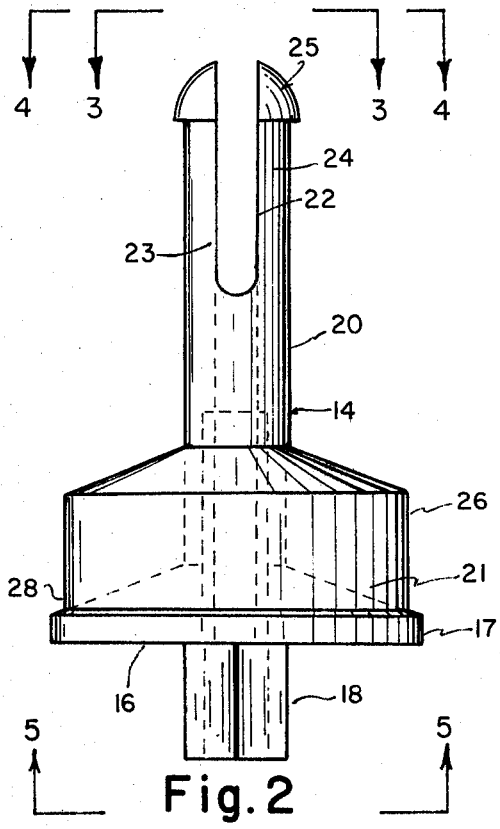
FIG. 2 is a side elevation view of the cymbal retainer.
Figure 4:
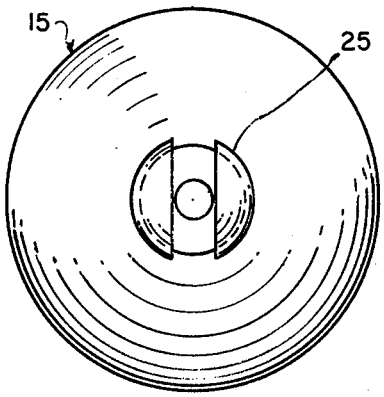
FIG. 4 is a fragmented, top view of the device taken generally on line 4—4 of FIG. 2, with the felt washer removed, looking in the direction of the arrows.
Figure 3:
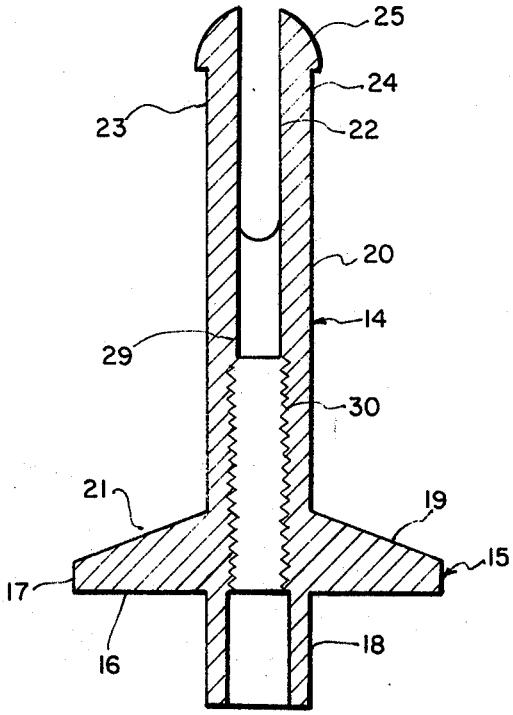
FIG. 3 is a fragmented, sectional view of the device taken on line 3—3 of FIG. 2 with the felt washer removed.
Figure 1:
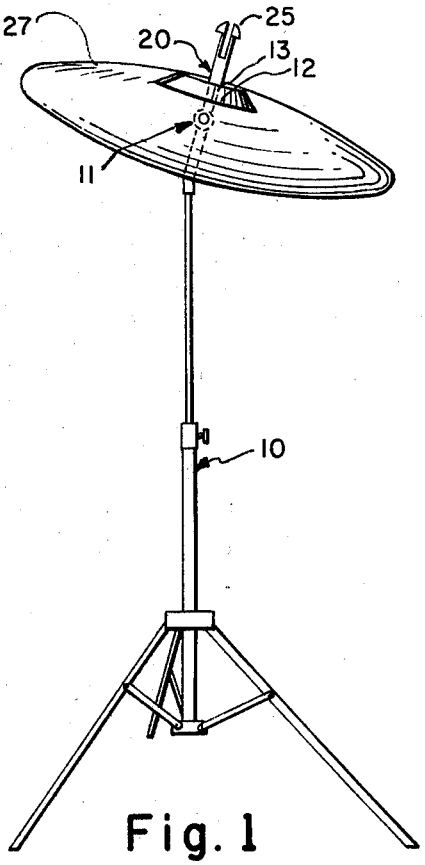
FIG. 1 is a perspective view of the device mounted on a cymbal stand supporting and retaining a cymbal in the playing position.
Figure 5:
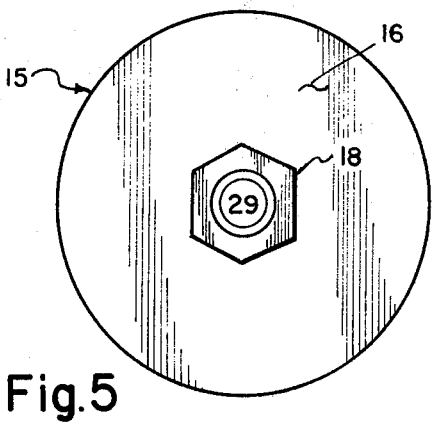
FIG. 5 is a bottom view of the device taken generally on line 5—5 of FIG. 2 looking in the direction of the arrows.

The preferred embodiment was constructed by machining a block of nylon stock. The device might be constructed by injecting molding of nylon or other durable plastic; however, nylon is indicated to be the preferred material. The device of this invention is designed to be mounted on a conventional cymbal stand 10 including an adjustable elbow 11 which projects into a cymbal rod 12 extending into a threaded support 13. The primary components of this invention is the unique construction of the cymbal retainer 14. Details of construction are perhaps best illustrated in FIGS. 2–5. For the dimensional aspects of the construction of the preferred embodiment your attention is particularly invited to FIGS. 2 and 3. The cymbal base 15 was machined to an exterior diameter of 1⅝ inches. Cymbal base 15 included a flat bottom portion 16 which projected upward ⅛ inch forming the cylindrical edge 17. Projecting downward at the center of cymbal retainer 14 from the cymbal base 15 was a 7/16 inch drive nut 18. This drive nut 18 was machined from the solid block of nylon and is one component constructed as a part of the unitary structure. Formed above the cymbal base 15 is a flared shoulder 19 machined on a 20° slope angle projecting from the interior outward to the edge of the cymbal base 15. Projecting upward from the cymbal base 15 is a 7/16 inch diameter cymbal neck 20. The portion of cymbal base 15 interconnecting cymbal neck 20 and the outer extremity of the cymbal base 15 is a 20° descending shoulder slope 21. The cymbal neck 20 projects upward from cymbal base 15 2 1/16 inches. Cymbal base 15 has an overall length of 7/16 inch and the drive nut 18 has an overall length of ½ inch making the entire structure 3 inches in length. Constructed in the end of the cymbal retainer 14 at the end opposite cymbal base 15 is the flared retaining head 25 with an outside diameter of 9/16 inch. The flared portion of the flared retaining head 25 projects 1/16 inch beyond the outside diameter of the cymbal neck 20. The arcuate outer surface of the flared retaining head 25 was machined from a center point at its base on a radius 9/32 inch forming a rounded upper surface for the flared retaining head 25. After machining the flared retaining head 25 in the block of nylon, a 3/16 inch flexing slot 22, 1 inch in length, was cut into the upper extremity of cymbal neck 20 projecting through the flared retaining head 25 terminating at an arc in the cymbal neck 20 machined on a radius from the center of 3/16 inch. This flexing slot 22 results in the formation of a first flexible arm 23 and a second flexible arm 24 which are ⅛ inch thick in their narrowest dimension illustrated in FIG. 3. This first flexible arm 23 and second flexible arm 24 project upward through the center hole in the cymbal 27. The expanded portion at the end constitutes the flared retaining head 25. In the preferred construction of the device of this invention a felt collar 1½ inches in diameter and ⅜ inch thick with a center hole having an inside diameter of 7/16 inch is placed around the cymbal neck 20 and rests on flared shoulder 19. A cymbal 27, of standard construction having a ½ inch inside diameter hole at its center, readily slips over the flexible retaining head 25 and rests on the felt collar 26.

The preferred embodiment was constructed with a 3/16 inch internal axial opening 29 projecting through the drive nut 18, cymbal base 15, and cymbal neck 20. The 3/16 inch mounting threads 30 were cut into the internal axial opening 29 to facilitate the securing of the cymbal retainer 14 to the threaded support 13 of the cymbal rod 12.

A preferred modification of this device was discovered by gluing the felt collar 26 to the flared shoulder 19. This collar glue 28 might comprise any of the wide variety of adhesives; however, by securing the felt collar 26 to flared shoulder 19 the tonal quality of the cymbal 27 and its action or the cymbal stand 10 in combination with the cymbal retainer 14 of this invention was found to improve the operation of the cymbal 27.

OPERATION OF THE DEVICE

The operation of the device of this invention is rather self-evidencing from an inspection of the drawings. Most all cymbals 27 throughout the industry have a ½ inch diameter support cymbal hole. The cymbal 27, accordingly, readily slips over the flared retaining head 25 of the cymbal retainer 14 and the cymbal 27 comes to rest on the felt collar 26 supported by the flared shoulder 19. In this position on the cymbal stand 10, the cymbal 27 is in a position to be played by the drummer. One of the advantages of playing the cymbal 27 on the device of this invention in the modified version when the felt collar 26 is glued to the flared shoulder 19 is consistency of tone and the preventing of rotation of the cymbal 27. The stability of the cymbal 27 in one position insures consistency of tone. With the present, multiple component cymbal retainer, including a wing nut, a cymbal tends to turn counterclockwise when the drummer uses conventional techniques of playing. Rotation of the cymbal 27 is undesirable because of the overtone nature of cymbals; the sound of the cymbal 27 changes as the cymbal 27 turns. The device of this invention is designed to permit the cymbal 27 to vibrate freely up and down; however, the cymbal retainer 14 tends to retard side motion. The one-piece cymbal retainer 14 of this invention firmly secured to the cymbal stand 10 tends to cause the weight of the cymbal 27 to restrict counterclockwise motion and generally tends to promote uniform tonal consistency throughout the course of the music.

Having described the construction of the device of this invention in detail, what is desired to be claimed is all modifications of the device not departing from the scope of equivalents of the invention as defined in the appended claims.

I claim:

1. A unitary cymbal retainer comprising:

a. a cymbal base having an upper surface and a lower surface, said base adapted to be secured to a cymbal stand, b. a sloping, flared shoulder constructed in the upper surface of said cymbal base, c. a cymbal neck projecting upward from said cymbal base, said cymbal neck terminating in, d. a flexible, flared retaining head at the upper extremity of said cymbal neck opposite said cymbal base, e. a flexing slot projecting through said flared retaining head dividing said cymbal neck into, f. a first flexing arm, and g. a second flexing arm.

2. The invention of claim 1 further comprising a drive nut projecting downward from the center of said lower surface of said cymbal base.

3. The invention of claim 1 further comprising a felt collar positioned around said cymbal neck.

4. The invention of claim 1 further comprising:

a. a felt collar positioned around said cymbal neck adjacent said sloping, flared shoulder, and b. collar glue attaching said felt collar to said flared shoulder.

5. The invention of claim 1 further comprising:

a. an axial opening projecting through the said cymbal base and said cymbal neck, and b. mounting threads formed in the surface of said axial opening facilitating the threadable attaching of the said cymbal retainer to a cymbal stand.

6. The invention of claim 1 further comprising:

a. a cymbal stand to which is attached said cymbal retainer, and b. a cymbal secured on said cymbal retainer.

* * * * *